United States Patent [19]

Matsuda et al.

[11] 4,211,901

[45] Jul. 8, 1980

[54] PRESSURE SENSING SWITCH WITH CONDUCTIVE DEFLECTABLE DIAPHRAGM

[75] Inventors: Akira Matsuda, Higashimurayama; Norio Goshima, Musashino; Shigeo Yasuda, Musashino; Motoaki Iwasaki, Musashino, all of Japan

[73] Assignees: Bridgestone Tire Company Limited; Mitaka Instrument Company Limited, both of Tokyo, Japan

[21] Appl. No.: 972,059

[22] Filed: Dec. 21, 1978

[30] Foreign Application Priority Data

Dec. 29, 1977 [JP] Japan ..... 52-177386[U]

[51] Int. Cl.[2] ..... H01H 35/34

[52] U.S. Cl. ..... 200/83 B; 200/83 N; 340/58; 200/61.25

[58] Field of Search ..... 200/61.25, 83 R, 83 P, 200/83 N, 83 B; 340/58, 605, 614, 626

[56] References Cited

U.S. PATENT DOCUMENTS

| | | | |
|---|---|---|---|
| 3,743,801 | 7/1973 | Brobeck | 200/83 N |
| 4,006,083 | 2/1977 | Westervelt | 200/83 P |

*Primary Examiner*—Gerald P. Tolin

*Attorney, Agent, or Firm*—Cushman, Darby & Cushman

[57] ABSTRACT

A pressure sensing switch for transducing the change of pneumatic pressure to an electrical signal comprises a diaphragm made of a material having a Young's modulus E of $1.0\times10^4$–$2.1\times10^4$ kg/mm$^2$, a Poisson's ratio V of 0.3, a thickness t of 0.02–0.2mm, a diameter d measured at a radially inner edge of a side wall portion being 5–10mm, a ratio of a radius or curvature R measured at a deflectable portion to a diameter d measured at the radially inner edge of the side wall portion being 2.5–5, and a maximum deflection Dmax of the deflectable area being $$(3.1\times10^{-3}-6.2\times10^{-3})\times\frac{Pd^4}{16Et^3}=0.2\text{–}0.4\text{mm}.$$

2 Claims, 4 Drawing Figures

PRESSURE SENSING SWITCH WITH CONDUCTIVE DEFLECTABLE DIAPHRAGM

The present invention relates to a pressure sensing switch for sensing the change of pneumatic pressure, and more particularly to a pressure sensing switch for transducing the change of pneumatic pressure to an electrical signal.

In a conventional metal bellow, the movement of the bellow caused by a back pressure is linear so that such movement is small in a small bellow, which renders it difficult to make adjustment of an operating pressure, resulting in low precision to the pressure sensing. Consequently, in order to make the adjustment of the operating pressure easier and attain a higher precision, the bellow must be of large size, which leads to the increase of the size of the entire pressure sensing switch. Another pressure sensing switch has been proposed which comprises a metallic diaphragm which instantly deflects from one dead point to the other dead point in response to a predetermined pressure applied thereto and a contact member having a contact point to be contacted with the diaphragm disposed in opposing relation with the diaphragm at one of the dead points of the diaphragm. In such a pressure sensing switch, however, the diaphragm instantly deflects from one dead point to the other dead point to contact with the contact point of the contact member so that an impact force is applied to the contact member each time the pressure sensing switch is activated. Consequently, a surface of the diaphragm which abuts against the contact member is damaged or the contact member is displaced, which leads to contact fault between the diaphragm and the contact member. Furthermore, in such a pressure sensing switch, an error is apt to exist between a preset pressure at which the diaphragm is to be deflected and an actual pressure at which the diaphragm is actually deflected. Accordingly, this type of pressure sensing diaphragm switch is not reliable. In addition, since the diaphragm instantly deflects, it is inherently accompanied with a hysteresis so that there exists a difference between a pressure required to deflect the diaphragm from one dead point to the other dead point and a pressure required to deflect the diaphragm in the opposite direction, that is, from the other dead point to the one dead point. This is also one extremely large drawbacks that block the improvement of reliability of the pressure sensing diaphragm switch.

It is, therefore, an object of the present invention to provide a pressure sensing switch which overcomes all of the problems discussed above and which eleminates any contact fault between the self-contained diaphragm and the contact member and uses the small diaphragm to eliminate any error caused by the deflection of the diaphragm itself to materially improve the reliability in sensing the change of fluid pressure.

The above and other objects, features and advantages of the present invention will become clear from the following particular description of the invention and the appended claims, taken in conjunction with the accompanying drawings which show by way of example a preferred embodiment of the present invention.

Figure 1:
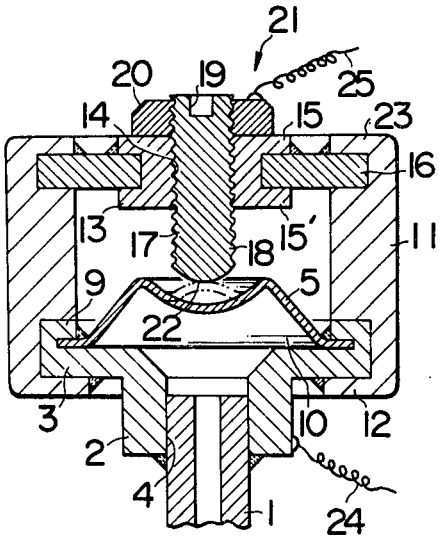
FIG. 1 shows a sectional view of a pressure sensing switch of the present invention.
Figure 2:
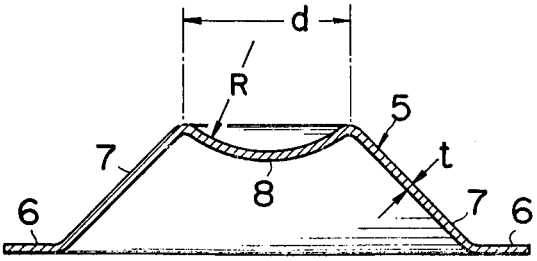
FIG. 2 shows a sectional view of a diaphragm used in the pressure sensing switch of FIG. 1.

Referring now to the drawings and in particular to FIG. 1, the reference numeral 1 denotes a pipe having one end connected with a pneumatic pressure source, not shown, such as an air chamber of a tire, and the reference numeral 2 denotes a flange member of a conductive material having a flange 3 at the top thereof. An aperture 4 having an inner diameter which is equal to a diameter of the pipe 1 is formed at the center of the flange 2. Inserted into the aperture 4 is the other end of the pipe 1, which is fixed thereto by soldering or silver soldering. The reference numeral 5 denotes a diaphragm manufactured by drawing a disk made of a single thin conductive plate. As best shown in FIG. 2, the diaphragm 5 comprises a ring-shaped peripheral portion 6, a frustoconical side wall portion 7 which is continuous to a radially inner edge of the peripheral portion 6 and extends upward therefrom, and a deflectable portion 8 which consititutes a portion of a sphere and which is continuous to a radially inner edge of the side wall portion 7 and extends downward therefrom. Turning back to FIG. 1, the diaphragm 5 is fixed to the flange member 2 by having the peripheral portion 6 held between the flange 3 and a fold-over portion 9 formed at a radially outer edge of the flange 3, and the diaphragm 5 is further sealed by soldering. The diaphragm 5 is made of a material having a Young's modulus E of $1.0 \times 10^4 - 2.1 \times 10^4$ kg/mm$^2$ and a Poisson's ratio V of 0.3. A thickness t of the diaphragm 5 is selected to be 0.02–0.2 mm, and a diameter d measured at a radially inner edge of the side wall portion 7 is selected to be 5–10 mm. A radius of curvature R of the deflectable portion 8 is selected to be 18–44 mm and a ratio of the radius of curvature R of the deflectable portion 8 to the diameter d at the radially inner edge of the side wall portion 7 is selected to be 2.5–5. In addition, a maximum deflection Dmax of the deflectable portion 8 expressed by a general formula of $$\mathrm{Dmax} = (3.1 \times 10^{-3} - 6.2 \times 10^{-3}) \times \frac{Pd^4}{16Et^3}$$

is selected to be 0.2–9.4 mm, where P in the general formula is a pressure (kg/cm$^2$) acting on the diaphragm 5. With the diaphragm 5 thus constructed, when the pressure in the pneumatic pressure source 10 defined by the diaphragm 5 and the flange member 2 varies within a predetermined pressure range resulting from the change of pressure of the pneumatic pressure source 10, the deflectable portion 8 of the diaphragm 5 can be gradually deflected between one dead point and the other dead point in response to the pressure changes, and the deflectable portion 8 can be more largely deflected near the intermediate level of the pressure range (that is, when the deflectable portion 8 reaches the vicinity of the intermediate position between the two dead points than other pressure ranges. In this case, the pressure range for the diaphragm 5 should be selected to be 0.2–10 kg/cm$^2$. The reference numeral 11 indicates a cylindrical case which is provided with a thin fold-over portion 12 at the bottom thereof. The flange member 2 to which the diaphragm 5 is fixed is inserted in the cylindrical case 11 and fixed thereto by the fold-over portion 12. The fixing is further enhanced by an adhesive material. The reference numeral 13 represents a nut member having a threaded bore 14 formed therethrough and a pair of fold-over portions 15 and 15' at the top and bottom thereof. A ring-shaped support member 16 made of an insulative material is mounted around an external periphery of the nut member 13 and held between the fold-over portions 15 and 15' so that the support member 16 is firmly fixed to the nut member 13. The fixing is further enhanced by adhesive material. A contact member 18 made of a conductive material and having a thread 17 around an outer circumference thereof is screwed into the threaded bore 14 of the nut member 13. The contact member 18 is formed with a slit 19 in the top surface thereof. By engaging an appropriate tool such as a screw driver to the slit 19 and turning it, the position of the screwed contact member 18 can be adjusted. The reference 20 denotes a locking nut, made of a conductive material, which is screwed around the contact member 18 until the bottom surface of the locking nut 20 abuts against the top surface of the nut member 13 to lock the position of the screwed contact member 18. Consequently, the nut member 13, the support member 16, the contact member 18 and the locking nut 20 are fixed in a unit and they constitute, as a whole, a contact assembly generally indicated by the reference numeral 21. The contact assembly 21 is positioned around the top of the cylindrical case 11 in such a way that a contact point 22 of the contact member 18 which is to be contacted with the deflectable portion 8 is disposed at the intermediate position between the dead points of the deflectable portion 8, that is, at a position which is substantially equi-distantly spaced from both the one dead point and the other dead point. The contact member 18 is fixed to the cylindrical case 11 by a thin fold-over portion 23 formed at the top of the cylindrical case 11, and the fixing is further enhanced by an adhesive material. The reference numeral 24 denotes a lead wire having one end connected to the flange member 2 by soldering and the other end connected to an alarming device not shown. The reference numeral 25 denotes another lead wire having one end connected to the locking nut 20 by soldering and the other end connected to the alarming device.

The operation of the embodiment of the present invention described above will be described hereinafter.

Figure 3:
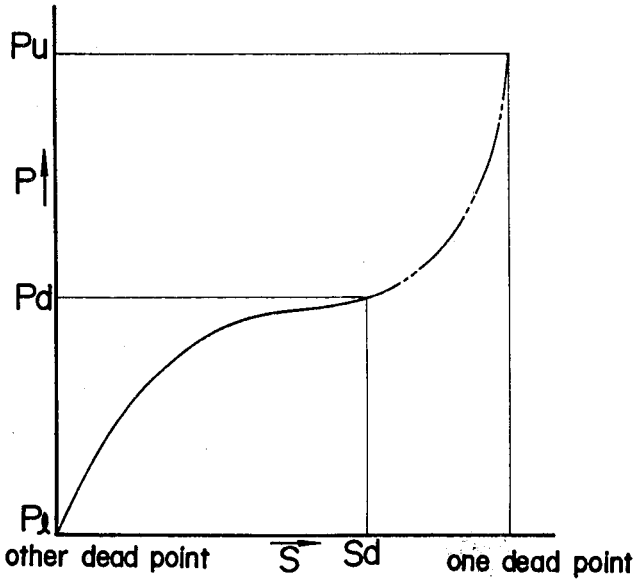
FIG. 3 shows a graph illustrating a relation between a pneumatic pressure acting on the diaphragm and a displacement of the diaphragm.

Initially, when the pressure of the pneumatic pressure source is held at a predetermined pressure level, for example, when the pressure of the air chamber of the tire is held at a normal tire pressure level, the pressure in the pneumatic chamber 10 is held at the same pressure level because of the connection through the pipe 1. In this case, the deflectable portion 8 of the diaphragm 5 is delfected to abut against the contact point 22 of the contact member 18, that is, to an intermediate position between one dead point and the other dead point, as shown by a phantom line in FIG. 1. As a result, the switch is turned on and an electric current flows through the lead wire 24, the flange member 2, the diaphragm 5, the contact member 18, the locking nut 20 and the lead wire 25. Under this condition, the alarm device is not actuated. When the pressure in the pneumatic chamber 10 then falls down by any reason to an upper limit pressure Pu at which the deflectable portion 8 of the diaphragm 5 starts to deflect from one dead point toward the other dead point, the deflectable portion 8 would start to deflect theoretically. In the present embodiment, however, since the deflectable portion 8 has been deflected by the contact member 18 to the intermediate position between the one dead point and the other dead point, it actually does not deflect. A phantom line in FIG. 3 shows a displacement of the deflectable portion 8 when the pressure in the pneumatic chamber 10 falls below the upper limit pressure Pu and if the diaphragm 5 is a single element, where an ordinate represents the pressure P and an abscissa represents the displacement S. As seen from FIG. 3, the deflectable portion 8 slowly deflects in the vicinity of the upper limit pressure Pu. When the pressure in the pneumatic chamber 10 then falls down to a preset pressure Pd, the deflectable portion 8 starts to gradually deflect from a preset position Sd at which the deflectable portion 18 abuts against the contact point 22 of the contact member 18 toward the other dead point. As the pressure in the pneumatic chamber 10 further falls below the preset pressure Pd, the deflectable portion 8 gradually deflects as shown by a solid line in FIG. 3. When the pressure in the pneumatic chamber 10 falls down to an intermediate level between the upper limit pressure Pu and a lower limit pressure Pl, the deflectable portion 8 deflects at a higher deflection rate than it deflected when the pressure is near the upper limit pressure Pu. As a result of the deflection of the deflectable portion 8 from the contact point 22 toward the other dead point, the deflectable portion 8 of the diaphragm 5 and the contact point 22 of the contact member 18 are spaced away from each other so that the switch is turned off. Consequently, the electric current no longer flows and the alarming device is actuated to give a warning to a driver. When the pressure in the pneumatic chamber 10 further falls down to the vicinity of the lower limit pressure Pl, the deflectable portion 8 again deflects slowly as shown in FIG. 3. If the pressure in the pneumatic chamber 10 further falls to reach the lower limit pressure Pl, the deflectable portion 8 reaches the other dead point so that is can no longer deflect. The position of the diaphragm 5 under this condition is shown by a solid line in FIG. 1.

When the pressure in the pneumatic chamber 10 rises over the lower limit pressure Pl, the deflectable portion 8 starts to gradually deflect from the other dead point toward the one dead point. Since the deflectable portion 8 deflects slowly, the displacement of the deflectable portion 8 traces the same displacement curve as that exhibited when the pressure fell, and hence no hysteresis occurs. When the pressure in the pneumatic chamber 10 then rises up to the preset pressure Pd, the deflectable portion 8 deflects to the preset position Sd. In this case, the deflectable portion 8 has been deflecting slowly, and therefore it softly abuts against the contact point 22 of the contact member 18. Accordingly, the outer surface of the deflectable portion 8 which is to be contacted with the contact point 22 will not be damaged and the position of the contact point 18 will not be displaced. As a result of deflection of the deflectable portion 8 to the preset position Pd, the deflectable portion 8 abuts against the contact point 22 of the contact member 18 so that the switch is turned on. In this type of pressure sensing switch, if it is desired to change the preset pressure Pd, the position of the screwed contact member 18 may be adjusted to move the contact member 18. In this case, since the contact point 22 of the contact member 18 is positioned intermediate the one dead point and the other dead point of the deflectable portion 8 where the deflectable portion 8 exhibits a high deflection rate, fine adjustment can be attained so that the preset pressure Pd can be easily adjusted with a high precision. Alternatively, the adjustment of the preset pressure may be done by exchanging the diaphragm itself.

In order to select the preset pressures of 0.2 kg/cm$^2$, 1.2 kg/cm$^2$, 5.5 kg/cm$^2$ and 10 kg/cm$^2$, it is most preferable that diaphragm 5 have the following dimension and shape as shown below.

| Preset pressure | Young's modulus E of diaphragm (kg/mm$^2$) | Thickness t of diaphragm (mm) | Diameter d at radially inner edge of side wall portion (mm) | Radius of Curveture R of deflectable portion (mm) |
|---|---|---|---|---|
| 0.2 kg/cm$^2$ | $1.3 \times 10^4$ | 0.035 | 7 | 32–44 |
| 1.2 kg/cm$^2$ | $1.3 \times 10^4$ | 0.06 | 7 | 25–35 |
| 5.5 kg/cm$^2$ | $1.3 \times 10^4$ | 0.1 | 7 | 20–28 |
| 10 kg/cm$^2$ | $1.3 \times 10^4$ | 0.12 | 7 | 18–26 |

Figure 4:
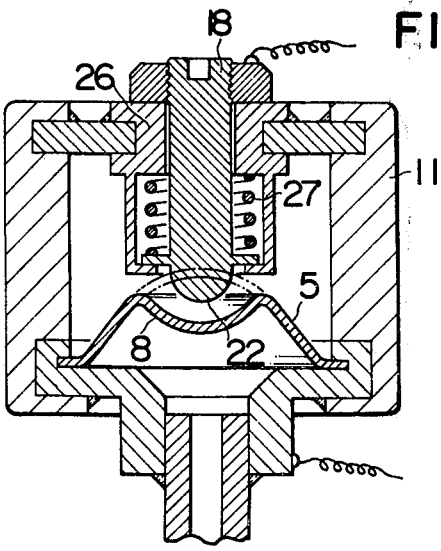
FIG. 4 shows a sectional view of another embodiment of the present invention.

While a normally closing type pressure sensing switch has been shown and described in the above embodiment, the contact member may be mounted under the diaphragm to provide a normally opening type switch. Furthermore, as shown in FIG. 4, the contact member 18 may be slidably inserted in an intermediate member 26 and a spring 27 for urging the contact member 18 toward the diaphragm 5 may be provided. In this case, since the spring 27 serves to absorb the impact caused by the deflectable portion 8 when the deflectable portion 8 deflects as shown by a phantom line, the damage of the deflectable portion 8 is further prevented.

Although particular embodiments of the present invention have been shown and described, it will be obvious to those skilled in the art that various changes and modifications may be made without departing from the spirit and scope of the present invention.

What is claimed is:

1. A pressure sensing switch comprising; a diaphragm having a ring-shaped peripheral portion, a frustoconical side wall portion being continuous to a radially inner edge of said peripheral portion and extending upward therefrom, and a deflectable portion constituting a portion of sphere and being continuous to a radially inner edge of said side wall portion and deflectable between one dead point and the other dead point in response to a pressure change within a predetermined pressure range; and a movable contact member positioned to face said diaphragm in such a way that a contact point of said contact member to be contacted with said deflectable portion of said diaphragm is positioned intermediate said one dead point and said other dead point of said deflectable portion; said diaphragm being made of a material having a Young's modulus E of $1.0\times10^4$–$2.1\times10^4$ kg/mm$^2$, Poisson's ratio V of 0.3 and a thickness t of 0.02–0.2 mm, a diameter d measured at the radially inner edge of said side wall portion being 5–10 mm, a radius of curvature R of said deflectable portion being 18–44 mm, a ratio of the radius of curvature R of said deflectable portion to the diameter d measured at the radially inner edge of said side wall portion being 2.5–5, and a maximum deflection Dmax as expressed by a general formula of $$\mathrm{Dmax} = (3.1 \times 10^{-3} - 6.2 \times 10^{-3}) \times \frac{Pd^4}{16Et^3}$$

where P is a pressure (kg/cm$^2$) acting on said diaphragm, being 0.2–0.4 mm.

2. A pressure sensing switch according to claim 1 wherein said contact point of said contact member to be contacted with said deflectable portion is positioned at a substantially central point between said one dead point and said other dead point of said deflectable portion.

* * * * *